US006385800B1

(12) United States Patent
Chen et al.

(10) Patent No.: US 6,385,800 B1
(45) Date of Patent: May 14, 2002

(54) COLLAPSIBLE PLAYYARD

(75) Inventors: Er-Jui Chen, Feng-Shan; Pao-Shan Huang, Tai Pao; Huang-Yi Cheng, Chia-I Hsien, all of (TW)

(73) Assignee: Link Treasure, Limited, Tortola (BV)

( * ) Notice: Subject to any disclaimer, the term of this patent is extended or adjusted under 35 U.S.C. 154(b) by 0 days.

(21) Appl. No.: 09/417,950

(22) Filed: Oct. 13, 1999

(51) Int. Cl.[7] ..... A47D 7/00
(52) U.S. Cl. ..... 5/99.1; 5/98.1; 5/93.1
(58) Field of Search ..... 5/99.1, 98.1, 93.1, 5/98.2

(56) References Cited

U.S. PATENT DOCUMENTS 5,163,191 A * 11/1992 Chan ..... 5/98.1
5,228,154 A * 7/1993 Brevi et al. ..... 5/99.1
5,530,977 A * 7/1996 Wang ..... 5/99.1
5,781,944 A * 7/1998 Huang ..... 5/99.1
5,906,014 A * 5/1999 Zhuang ..... 5/99.1
6,125,483 A * 10/2000 Stroud et al. ..... 5/99.1
6,202,229 B1 * 3/2001 Cheng ..... 5/99.1

* cited by examiner

*Primary Examiner*—Lynne H. Browne
*Assistant Examiner*—James M. Hewitt
(74) *Attorney, Agent, or Firm*—W. Wayne Liauh

(57) ABSTRACT

A collapsible playyard capable of being securely expanded to a first position and folded to a second position. It includes a foldable upper frame and a collapsible lower frame. The collapsible lower frame includes a pair of central frame members pivotably connected to a second lock structure, and the second lock structure includes a U-shaped cover and a grasp handle connected to a base portion of the U-shaped cover to flip the U-shaped cover. The U-shaped cover includes two connecting portions each having a pair of bulges located on an inside face of the connecting portion facing each other. Each of the central frame members has corresponding fillisters, such that when the U-shaped cover is laid at a horizontal direction, the bulges and the fillisters will be engaged causing the lower frame be locked in an expanded position, which can be unlocked by flipping the U-shaped cover into a vertical direction.

7 Claims, 9 Drawing Sheets

COLLAPSIBLE PLAYYARD

BACKGROUND OF INVENTION

1.Field of the Invention

The present invention relates generally to collapsible playyards and more particularly to a playyard for an infant which is collapsible between a spread position while in use and a folded position while not in use.

2.Related Art

The playyards disclosed in the U.S. Pat. No. 4,811,437, U.S. Pat. No. 4,985,948, U.S. Pat. No. 5,163,191, U.S. Pat. No. 5,697,111 and U.S. Pat. No. 5,727,265 provide different kinds for an infant to play safely therein. Moreover, the U.S. Pat. No. 4,811,437, U.S. Pat. No. 5,697,111 and U.S. Pat. No. 5,727,265 provide playyards which are capable of changing between a spread position and a folded position by folding their frame structure which is generally composed of an upper frame, a lower frame and supporting members. For sake of safety of the infant in a playyard, the frame structure of the playyard needs to be kept in the spread position steadily and firmly by applying a safety lock structure. In the U.S. Pat. No. 4,811,437 and U.S. Pat. No. 5,697,111, they introduce a plurality of first safety lock structures at the interval of the frame members of the upper frame and a second safety lock structure at the interval of the frame members of the lower frame. Users must release the first and the second safety lock structures individually to fold the frames from spread position. A plurality of safety lock structures are also equipped in the U.S. Pat. No. 5,727,265 to secure the safety while in using. However, in the U.S. Pat. No. 4,811,437 and U.S. Pat. No. 5,697,111, their structures of the second safety lock structures are more complicated and are composed of many elements.

SUMMARY OF THE INVENTION

Accordingly, the present invention provides mainly a collapsible playyard, which at least comprises an upper frame, a lower frame, supporting members and a plurality of wall clothing members to enclose an activity space with an opening on the top. The upper frame is composed of four frame members which further include two upper frame member sections for each. The two upper frame member sections are pivotally connected by the first lock structure in a straight manner and can only be folded toward each other after the first lock structure is released. The lower frame is also composed of four frame members which further include two lower frame member sections for each. Similarly, the two lower frame member sections are pivotally connected by the second lock structure. The second lock structure is substantially 'U' shaped and can attain either a locked position, where the two lower frame member sections pivotally connected are in a straight manner, or an unlocked one, where the two lower frame member sections pivotally connected can be folded toward each other, by turning the lock structure in the open direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE PREFERRED EMBODIMENT

Figure 1:
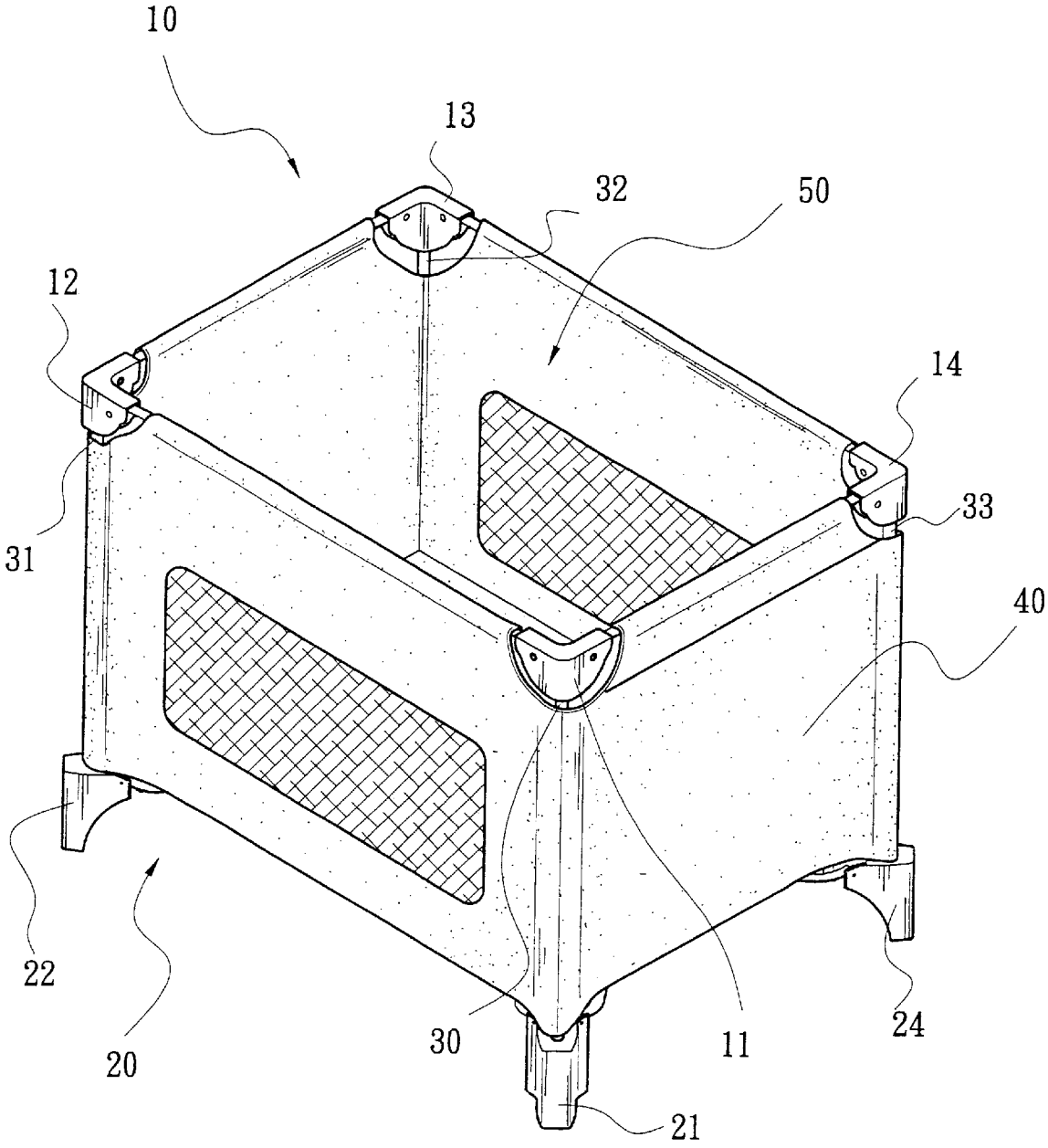
FIG. 1 is a perspective view of the present invention.
Figure 2:
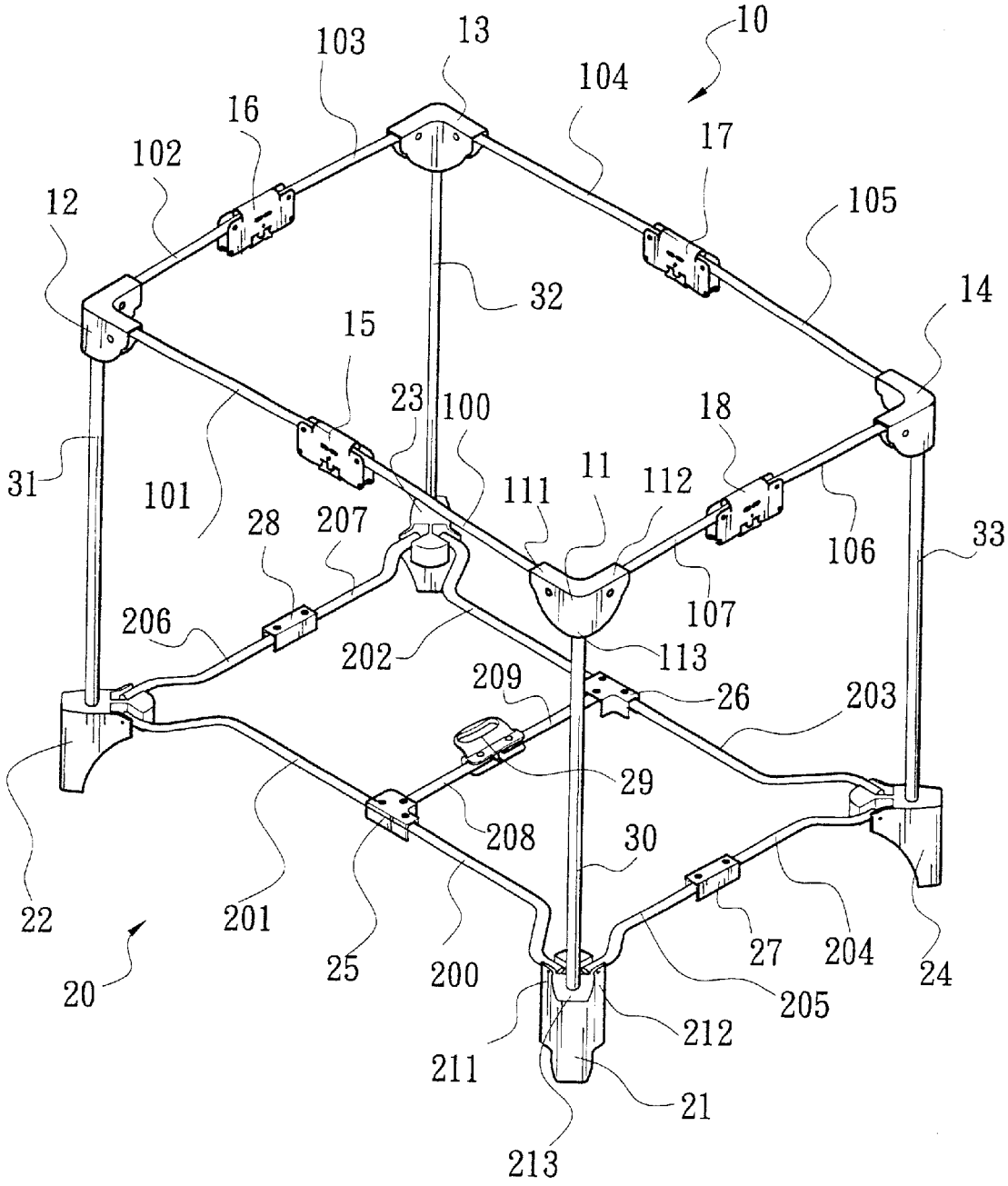
FIG. 2 is a perspective view of the structure of the present invention.
Figure 3:
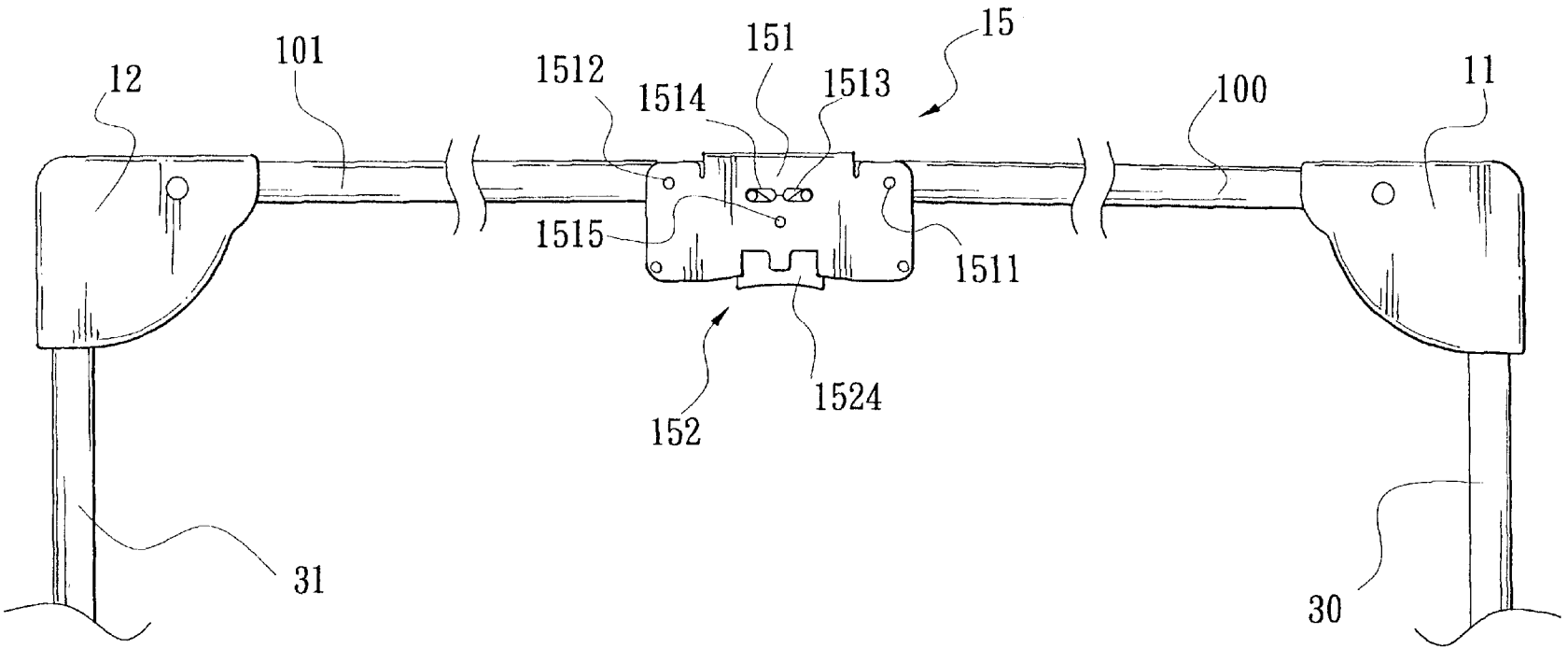
FIG. 3 is an enlarged perspective view of the upper frame of the present invention in a spread position.
Figure 4A:
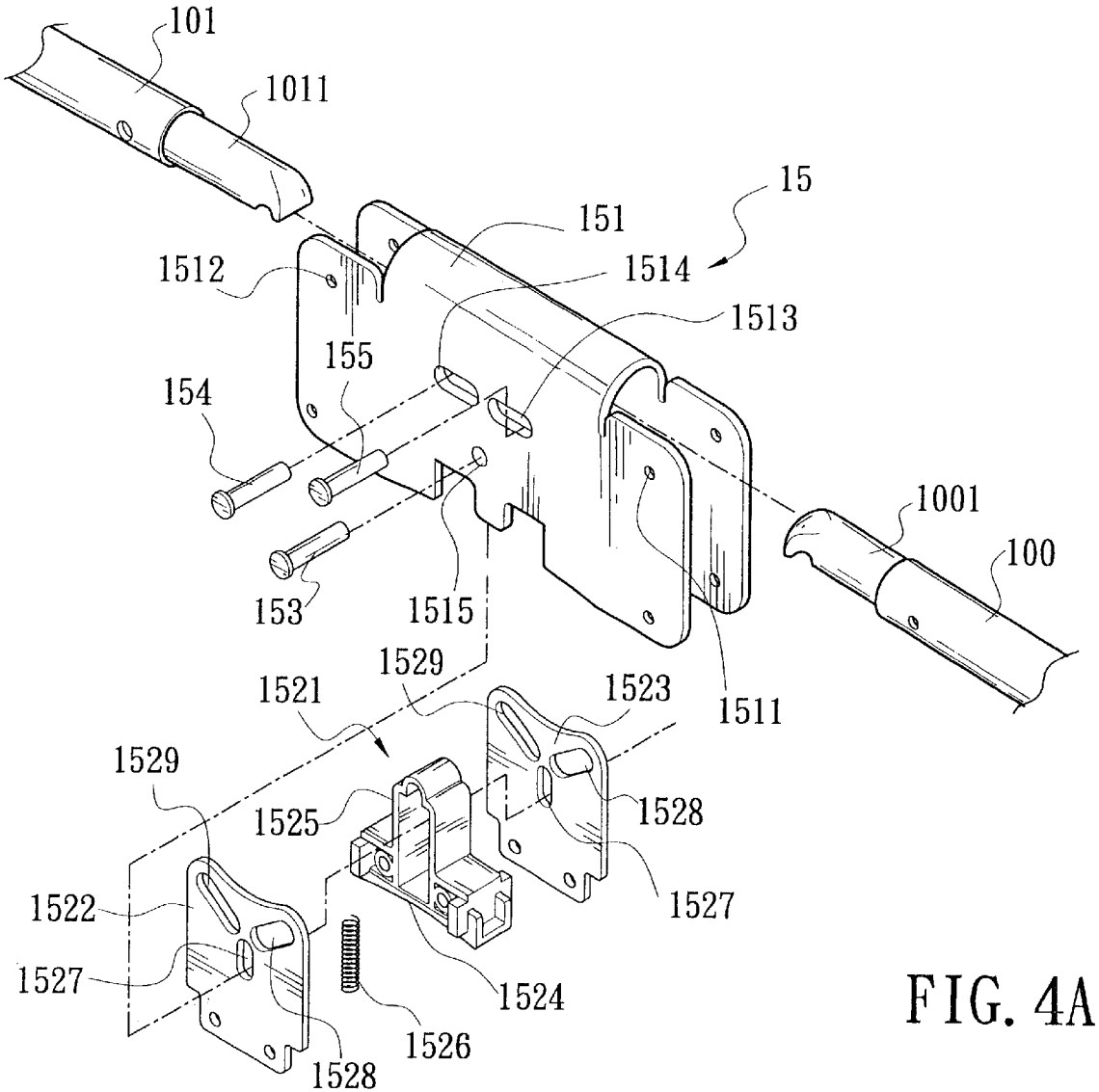
FIG. 4A is an exploded view of the detailed structure of the first lock structure of the present invention.
Figure 4B:
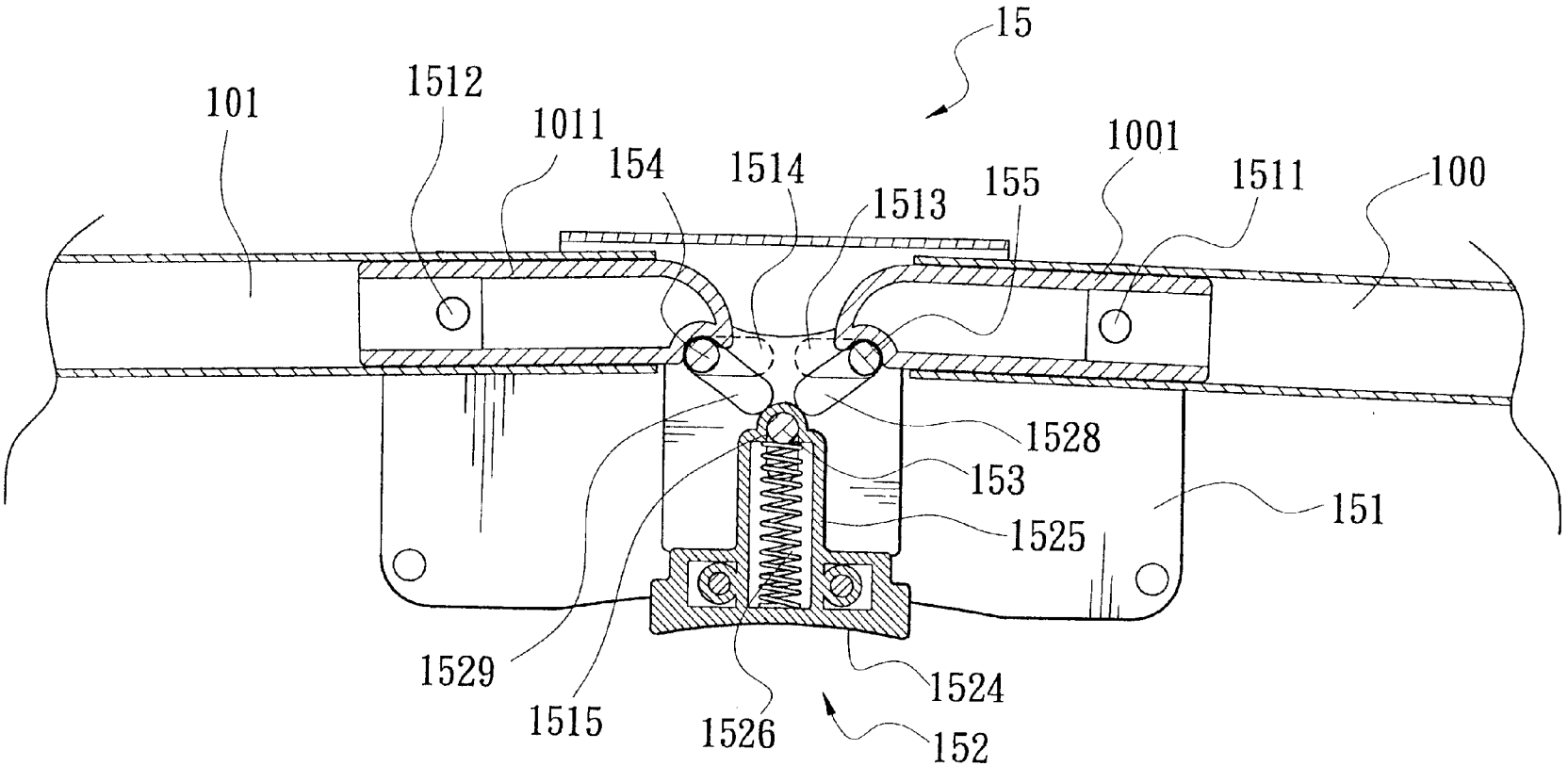
FIG. 4B is a sectional view of the first lock structure of the present invention.
Figure 4C:
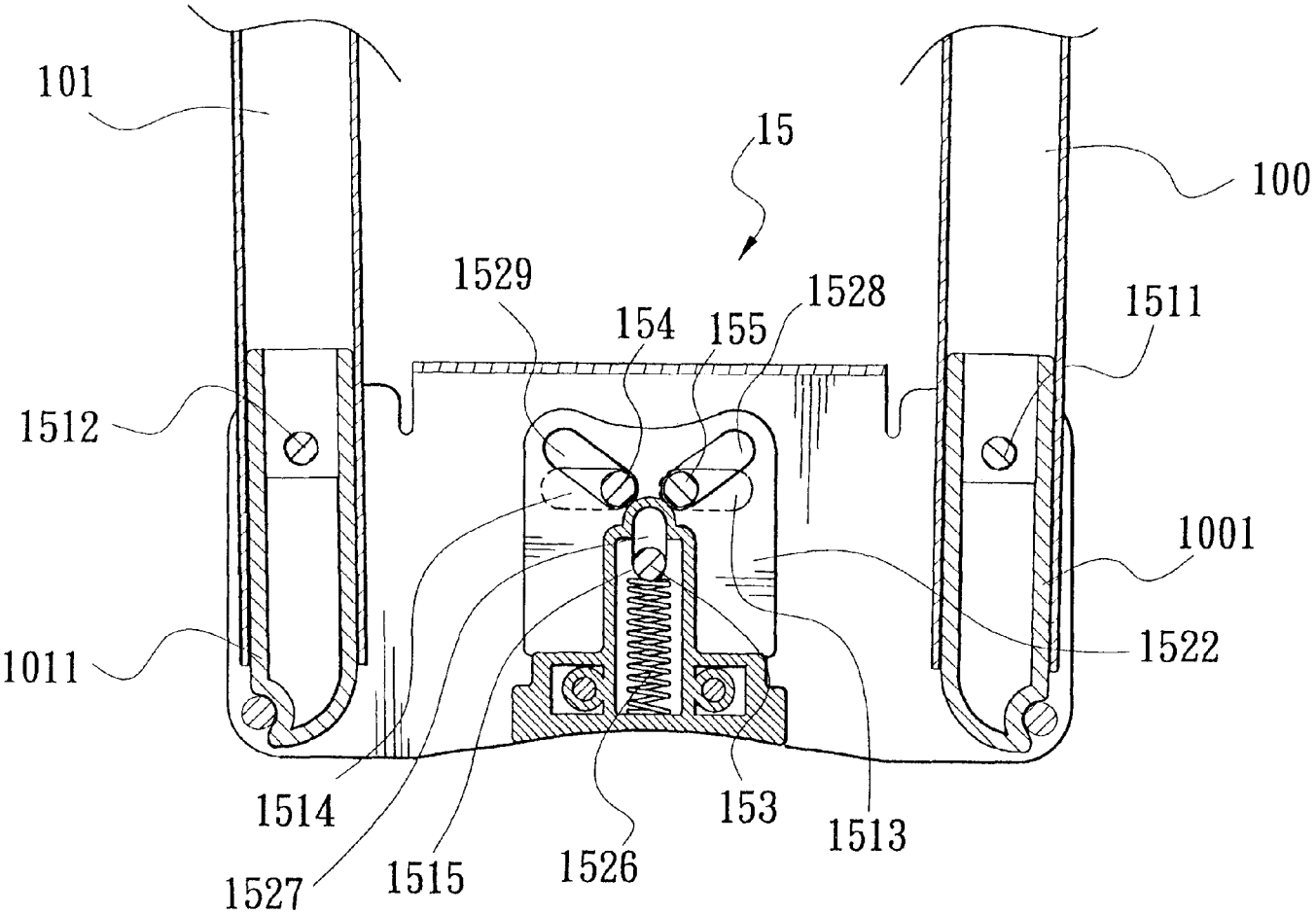
FIG. 4C is a sectional view of the first lock structure of the present invention , depicting the operation positions.

Referring first to FIG. 1 and FIG. 2, an embodiment of the present invention provides a collapsible playyard which includes an upper frame 10, a lower frame 20, four supporting members 30, 31, 32 and 33 and a plurality of wall clothing members 40 to enclose an activity space 50 with an opening on the top.

The upper frame 10 is composed of corner connecting parts 11, 12, 13 and 14, a plurality of upper frame member sections 100, 101, 102, 103, 104, 105, 106, 107 and 108 and first lock structures 15, 16, 17 and 18. The corner connecting part 11, taking the corner connecting part 11 as an example hereinafter, is about the shape of an 'L', has connecting ends 111 and 112 which are mutually perpendicular thereto and has a vertical connecting end 113 which is perpendicular to connecting ends 111 and 112 respectively. The upper frame member sections 100 and 107 are pivotally connected to the connecting ends 111 and 112 at one end thereof and are restricted to pivot downward only. Accordingly, the upper frame member sections 101 and 102 are pivotally connected to the corner connecting part 12 with only downward pivotal movement. The upper frame member sections 103 and 104 are pivotally connected to the corner connecting part 13 with only downward pivotal movement. The upper frame member sections 105 and 106 are pivotally connected to the corner connecting part 14 with only downward pivotal movement. The first lock structure 15 is pivotally connected to the other end of the upper frame member sections 100 and 101 respectively. Accordingly, the first lock structure 16 is pivotally connected to the other end of the upper frame member sections 102 and 103 respectively. The first lock structure 17 is pivotally connected to the other end of the upper frame member sections 104 and 105 respectively. The first lock structure 18 is pivotally connected to the other end of the upper frame member sections 106 and 107 respectively. Thus, the corner connecting parts 11 to 14, the upper frame member sections 100 to 107 and the first lock structure 15 to 18 compose a rectangle body frame.

The lower frame 20 is composed of corner connecting parts 21, 22, 23 and 24, a plurality of long lower frame member sections 200, 201, 202 and 203, a plurality of short lower frame member sections 204, 205, 206 and 207, two central frame members 208 and 209, two lower connecting parts 25 and 26, two side lower connecting parts 27 and 28 and a second lock structure 29. The corner connecting part 21, taking the corner connecting part 21 as an example hereinafter, is at least composed of two connecting ends 211 and 212 which are mutually perpendicular thereto and a upward vertical connecting end 213 which is perpendicular to connecting ends 211 and 212 respectively. The long lower frame member section 200 and the short lower frame member section 205 are pivotally connected to the connecting ends 211 and 212 at one end thereof and are restricted to pivot upward only. Accordingly, the long lower frame member section 201 and the short lower frame member section 206 are pivotally connected to the corner connecting part 22 with only upward pivotal movement. The long lower frame member section 202 and the short lower frame member section 207 are pivotally connected to the corner connecting part 23 with only upward pivotal movement. The long lower frame member section 203 and the short lower frame member section 204 are pivotally connected to the corner connecting part 24 with only upward pivotal movement. The lower connecting part 25 is pivotally connected to the other end of the long lower frame member sections 200 and 201 respectively. Accordingly, the lower connecting part 26 is pivotally connected to the other end of the long lower frame member sections 202 and 203 respectively. The lower connecting part 27 is pivotally connected to the other end of the short lower frame member sections 204 and 205 respectively. The lower connecting part 28 is pivotally connected to the other end of the short lower frame member sections 206 and 207 respectively. Thus, the long lower frame member sections 200 to 203, a plurality of short lower frame member sections 204 to 207, two lower connecting parts 25 and 26, two side lower connecting parts 27 and 28 and a second lock structure 29 compose a rectangle body frame. The long lower frame member sections 200 to 203 and the short lower frame member sections 204 to 207 concave slightly inward. The lower connecting parts 25 and 26 connect to the central frame members 208 and 209. The central frame members 208 and 209 pivotally connect to the second lock structure 29 at the other end separately.

The supporting members 30 to 33 connect to the corner connecting parts 11 to 14 at one end and to the corner connecting parts 21 to 24 individually. Accordingly, the upper frame 10, the lower frame 20 and supporting members 30 to 33 connect to construct a cubic body frame. Therefore, the wall clothing members 40 enclose the bottom face and surrounding faces of the cubic body frame. This forms a confined space for an infant to play inside.

Referring to FIG. 3, 4A, 4B and 4C, in the spread status of the collapsible playyard, the upper frame member sections 100 and 101 are connected in a straight line with their one end connected to corner connecting parts 11 and 12 and the other end connected to the first lock structure 15. The other upper frame member sections of the upper frame are similarly connected. The first lock structure 15 includes a U-shaped cover 151 and a control portion 152, wherein the U-shaped cover 151 at least includes two pivoting portions 1511 and 1512, a pair of guiding slots 1513 and 1514 and an aperture 1515. The pivoting portions 1511 and 1512 are provided for connecting the buckling portions 1001 and 1002 extending from one end of the upper frame member sections 100 and 101. The guiding slots 1513 and 1514 have a first position at the right most end thereof and a second position at the left most end respectively. The control portion 152 includes a T-shaped seat 1521 and two side plate 1522 and 1523. The T-shaped seat 1521 further has a pressing portion 1524 and a protruding portion 1525 which is hollow inside and has a spring equipped inside. The side plate 1522 and 1523 are located on both sides of the protruding portion 1525, and have a vertical guiding slot 1527 located at the position corresponding to the hollow space of the protruding portion 1525 and a pair of declining guiding slots 1528 and 1529 which mutually take a shape of 'V'. The vertical guiding slot 1527 also has a first position at the upper most end and a second position at the lower most end. The control portion 152 is located on the center of the U-shaped cover 151 and is connected by a pivot 153 which goes through the aperture 1515 of the U-shaped cover 151, the guiding slot 1527 of the control portion 152 and the hollow space of the protruding portion 1525. The spring 1526 then forces against the pivot 153. Therefore, the control portion 152 moves along the vertical guiding slot 1527. Accordingly, the control portion 152 keeps its position at the second position of the vertical guiding slot 1527 while the spring 1526 is on its normal and un-compressed position and at the first position of the vertical guiding slot 1527 while the spring 1526 is compressed by pushing the pressing portion 1524.

Figure 7:
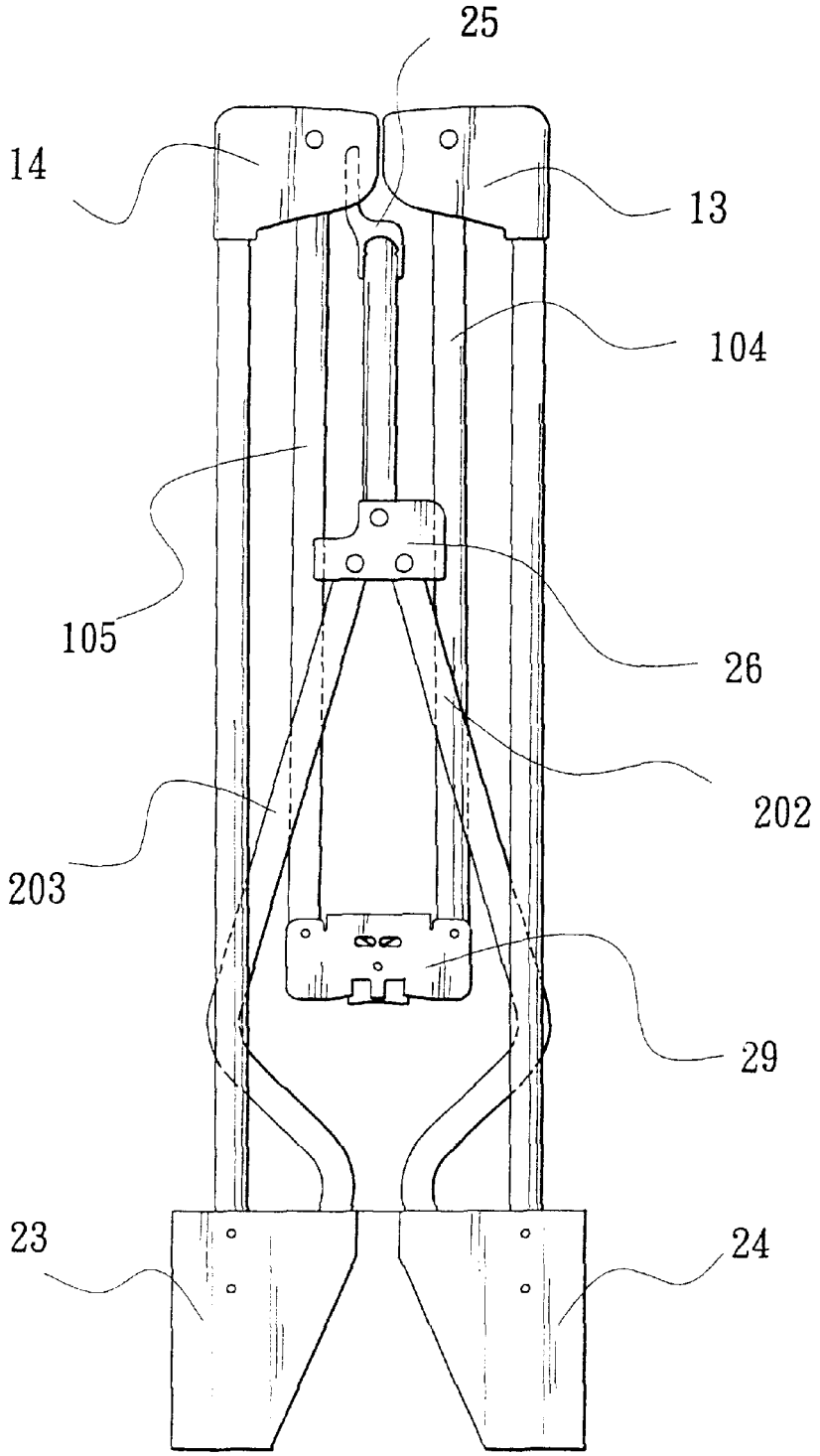
FIG. 7 is a side view of the present invention in a folded position.

When the control portion 152 keeps its position at the first position of the vertical guiding slot 1527, the first position of the declining guiding slots 1528 and 1529 is corresponding to the first position of the guiding slots 1513 and 1514 of the U-shaped cover 151 separately. After the control portion 152 moves to the end position, the first position of the vertical guiding slot 1527, the second position of the declining guiding slots 1528 and 1529 is corresponding to the second position of the guiding slots 1513 and 1514 respectively. Pins 154 and 155 passes through the guiding slots 1513 and 1514 and the declining guiding slots 1528 and 1529 individually. When the control portion 152 moves from the first position of the vertical guiding slot 1527 to the second position thereof, the declining guiding slots 1528 and 1529 will push the pins 154 and 155 from the first position of the guiding slots 1513 and 1514 toward the second position thereof. The buckling portions 1001 and 1002 of the upper frame member section 100 and 101 buckle up the pins 154 and 155 when the pins 154 and 155 are on the first position of the declining guiding slots 1528 and 1529. This will keep the upper frame member sections 100 and 101 on the same axis, that is, on their spread status. When the control portion 152 is pressed, the pins 154 and 155 move along the declining guiding slots 1528 and 1529 and ,therefore, move along the guiding slots 1513 and 1514 from the first position thereof toward the second position thereof. The upper frame member sections 100 and 101 escape from the pins 154 and 155 and turn to folding status, as shown in FIG. 7.

Figure 5:
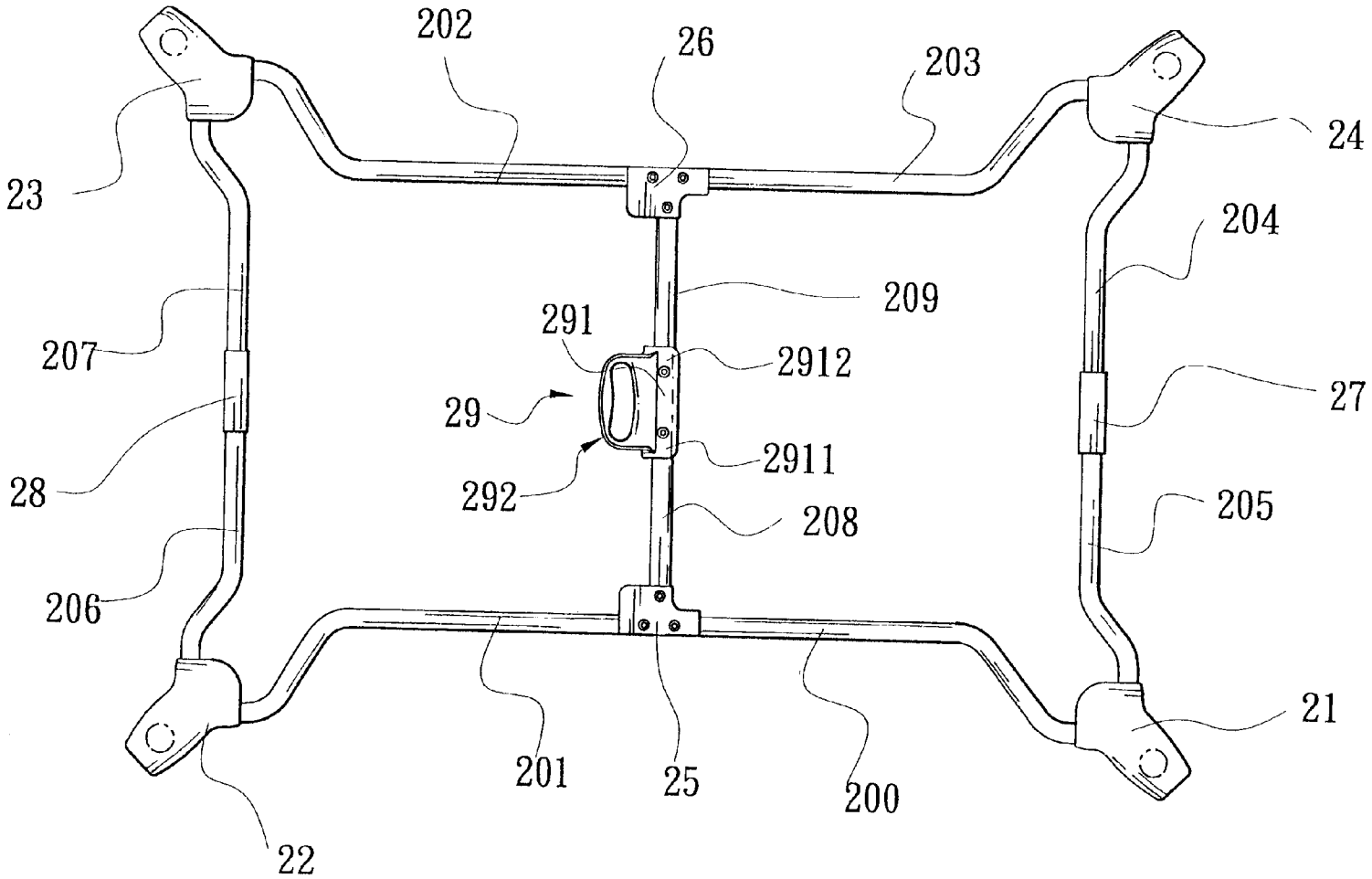
FIG. 5 is a upper view of the lower frame of the present invention in a spread position.
Figure 6B:
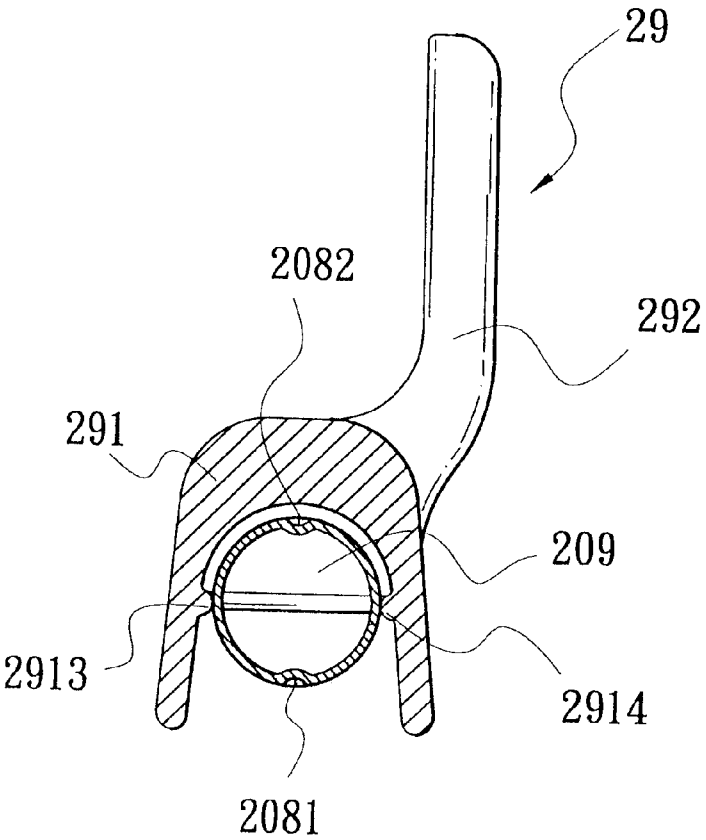
FIG. 6B is a sectional view of the second lock structure of the present invention, depicting the second operation position.
Figure 6A:
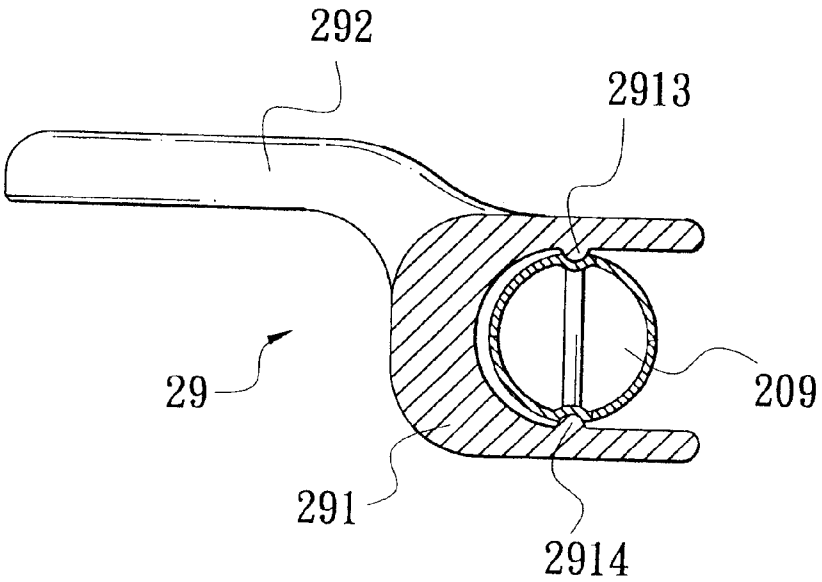
FIG. 6A is a sectional view of the second lock structure of the present invention, depicting the first operation position.

Referring to FIG. 5, when the collapsible playyard is in spread status, the long lower frame member sections 200 to 203, the short lower frame member sections 204 to 207 and the central frame members 208 and 209 of the lower frame 20 keep on the same horizontal plane by the connection of two lower connecting parts 25 and 26, two side lower connecting parts 27 and 28 and a second lock structure 29. The lower connecting parts 25 and 26 and side lower connecting parts 27 and 28 are all U-shaped covers and confine the long lower frame member sections 200 to 203 and the short lower frame member sections 204 to 207 to rotate downward only. The second lock structure 29 includes a U-shaped cover 291 and a grasp handle 292 constructed on backside of the U-shaped cover 291. The U-shaped cover 291 further includes two connecting portions 2911 and 2912 which have bulges 2913 and 2914 located on the interval between concave bottom and the open end edge thereof inside respectively and face to face. Also, there are corresponding fillisters 2081 and 2082 on the central frame members 208 and 209 thereof. When the collapsible playyard is in spread status, the normal direction of the open mouth of U-shaped cover 291 is horizontal, and bulges 2913 and 2914 of the connecting portions 2911 and 2912 buckle up fillisters 2081 and 2082 of the central frame members 208 and 209 separately. This makes the U-shaped cover 291 keep on a locked position and makes the central frame members 208 and 209 not move. Therefore, the lower frame 20 keeps on spread status. When the grasp handle 292 is turned the open mouth of the U-shaped cover 291 moves downward and the fillisters 2081 and 2082 of the central frame members 208 and 209 release from bulges 2913 and 2914 of the connecting portions 2911 and 2912, the U-shaped cover 291 is on released position. In this case, when the grasp handle 292 is pulled up, the central frame members 208 and 209 will then turn and get closer to each other and lower connecting parts 25 and 26 are also pulled up by the connection with the central frame members 208 and 209. Accordingly, this also makes the long lower frame member sections 200 to 203 turn downward and get closer to each other ,and so do the short lower frame member sections 204 to 207. The collapsible playyard collapses in this way, as shown in FIG. 7.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A collapsible playyard capable of being expanded to a first position and folded to a second position, comprising:

an upper frame, said upper frame being foldable and including a plurality of corner connecting parts, a plurality of pairs of upper frame member sections, and a plurality of first lock structures, wherein one end of each of said upper frame member sections is connected to a respective one of said corner connecting parts and the other end of each is connected to respective one of said first lock structures and every pair of said upper frame member sections are locked by a respective one of said first lock structures when said collapsible playyard is in the first position and released from said first lock structure when said collapsible playyard is in the second position;

a lower frame, said lower frame including a collapsible frame, which can be changed between the first and second positions, and a second lock structure connected to said collapsible frame, wherein said collapsible frame comprises a pair of central frame members pivotably connected to said second lock structure, and said second lock structure comprises a U-shaped cover and a grasp handle connected to a base portion of said U-shaped cover;

a plurality of supporting members connecting said corner connecting parts of said upper frame and the corner parts of said lower frame to form a cubic body frame; and a plurality of wall clothing members enclosing the bottom face and surrounding faces of said cubic body frame to form a confined space for an infant to play inside;

further wherein said U-shaped cover includes two connecting portions each having a bulge located on an inside face there of, said bulges facing each other, each of said central frame members has a corresponding fillister, such that when said U-shaped cover is placed in a first direction, said bulges and said fillisters will be engaged causing said lower frame be locked in an expanded position, and when said U-shaped cover is placed in a second direction said bulges and fillisters disengage causing said lower frame to be unlocked.

2. A collapsible playyard as described in claim 1, wherein said collapsible frame further comprises a plurality of corner connecting parts, a plurality of long lower frame member sections, a plurality of short lower frame member sections, a plurality of lower connecting parts and a plurality of side lower connecting parts, wherein one end of each of said long lower frame member sections is connected to one end of a respective one of said short lower frame member sections at a respective corner connecting part for pivoting upward only, each of said lower connecting parts is pivotally connected to the other end of a respective one of said long lower frame member sections, each of said lower connecting parts is connected to a respective one of said central frame members.

3. A collapsible playyard as described in claim 2, wherein each said side lower connecting part is an inverted U-shaped cover which confines said long lower frame member sections and said short lower frame member sections to rotate upwardly only.

4. A collapsible playyard as described in claim 1, wherein said first direction is a horizontal direction.

5. A collapsible playyard as described in claim 1, wherein said U-shaped cover of said second lock structure pivotally connects to said central frame member to confine said long lower frame member sections and said short lower frame member sections to rotate upward only.

6. A collapsible playyard capable of being expanded to a first position and folded to a second position, comprising:

a foldable upper frame;

a lower frame, said lower frame including a collapsible frame, and a second lock structure connected to said collapsible frame, wherein said collapsible frame comprises a pair of central frame members pivotably connected to said second lock structure, and said second lock structure comprises a U-shaped cover and a grasp handle connected to a base portion of said U-shaped cover;

wherein said U-shaped cover includes two connecting portions each having a bulge located on an inside face there of, said bulges facing each other, each of said central frame members has a corresponding fillister, such that when said U-shaped cover is placed in a first direction, said bulges and said fillisters will be engaged causing said lower frame to be locked in an expanded position, and when said U-shaped cover is placed in a second direction, said bulges and fillisters disengage causing said lower frame to be unlocked.

7. A collapsible playyard capable of being expanded to a first position and folded to a second position, comprising:

an upper frame, said upper frame being foldable and including a plurality of corner connecting parts, a plurality of pairs of upper frame member sections, and a plurality of first lock structures, wherein one end of each of said upper frame member sections is connected to a respective one of said corner connecting parts and the other end of each is connected to respective one of said first lock structures, and every pair of said upper frame member sections are locked by a respective one of said first lock structures when said collapsible playyard is in the first position and released from said first lock structure when said collapsible playyard is in the second position;

a lower frame, said lower frame including a collapsible frame and a second lock structure connected to said collapsible frame, wherein said collapsible frame comprises a pair of central frame members pivotably connected to said second lock structure, and said second lock structure comprises a U-shaped cover and a grasp handle connected to a base portion of said U-shaped cover, said U-shaped cover being structured to be engaged with portions of said central frames when said U-shaped cover is flipped into a first direction causing said playyard to be in a secured expanded position, and be disengaged with portions of said central frames when said U-shaped cover is flipped into a second direction allowing said playyard to be folded;

a plurality of supporting members connecting said corner connecting parts of said upper frame and the corner parts of said lower frame to form a cubic body frame; and a plurality of wall clothing members enclosing the bottom face and surrounding faces of said cubic body frame to form a confined space for an infant to play inside.

* * * * *